US008078090B2

(12) United States Patent
Shiiya

(10) Patent No.: US 8,078,090 B2
(45) Date of Patent: Dec. 13, 2011

(54) TRANSFER DEVICE AND IMAGE FORMING APPARATUS INCLUDING THE SAME

(75) Inventor: Tomoyuki Shiiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 443 days.

(21) Appl. No.: 12/353,568

(22) Filed: Jan. 14, 2009

(65) Prior Publication Data

US 2009/0185839 A1 Jul. 23, 2009

(30) Foreign Application Priority Data

Jan. 22, 2008 (JP) ..... 2008-011327
Sep. 22, 2008 (JP) ..... 2008-242290

(51) Int. Cl.
*G03G 15/16* (2006.01)

(52) U.S. Cl. ..... 399/313

(58) Field of Classification Search ..... 399/313, 399/314

See application file for complete search history.

(56) References Cited

U.S. PATENT DOCUMENTS 7,937,016 B2 * 5/2011 Kamijo et al. ..... 399/98
2005/0123326 A1 * 6/2005 Ito et al. ..... 399/313
2008/0019717 A1 * 1/2008 Soshiroda ..... 399/45

FOREIGN PATENT DOCUMENTS

JP 2001-166611 6/2001

* cited by examiner

*Primary Examiner* — David Gray
*Assistant Examiner* — Ruth Labombard
(74) *Attorney, Agent, or Firm* — DLA Piper LLP (US)

(57) ABSTRACT

A transfer device includes: a first transfer belt; a first and second roller on which the first transfer belt is wound; a second transfer belt which makes contact with the first transfer belt; a third roller on which the second transfer belt is wound, and which makes contact with the first roller via the first transfer belt and the second transfer belt; a fourth roller on which the second transfer belt is wound, and which makes contact with the second roller via the first transfer belt and the second transfer belt; a first drive force transmission mechanism which transmits a drive force to the first roller; and a second drive force transmission mechanism which transmits a drive force to the third roller.

13 Claims, 7 Drawing Sheets

TRANSFER DEVICE AND IMAGE FORMING APPARATUS INCLUDING THE SAME

BACKGROUND

1. Technical Field

The present invention relates to a transfer device which transfers a toner image transferred to an image carrier belt to a transfer material such as paper, and to an image forming apparatus including the same.

2. Related Art

To date, in an image forming apparatus using a liquid developer, an image forming apparatus including a transfer device which transfers a toner image transferred to an image carrier belt to a transfer material, such as paper, has been proposed (for example, refer to a patent document JP-A-2001-166611). In a transfer device used in an image forming apparatus disclosed in the patent document, a transfer belt is rotatably wound on two rollers, and brought into pressure contact with an opposite roller via an image carrier belt, forming a long nip.

In the transfer device described in the patent document, a configuration for stably driving the transfer belt is not disclosed.

In the transfer device using the liquid developer, in a case of adopting a configuration such that the transfer belt is moved in conjunction with the image carrier belt, a problem occurs in that it is not possible to obtain a stable conjoined movement due to a reduction in friction coefficient in a long nip portion caused by a burden due to a cleaning of the transfer belt, or by an encroachment of a remaining toner or carrier into a belt underside. Unless it is possible to obtain the stable conjoined movement of the transfer belt, carriers or toners become likely to be deposited at a transfer nip entrance, and there is a possibility of soiling the transfer material.

SUMMARY

An advantage of some aspects of the invention is to provide a transfer device in which, as well as a long nip being formed, making a transfer efficiency still better, an image carrier belt and a transfer belt being stably driven in a long nip portion, it is possible to prevent an image deterioration, and to provide an image forming apparatus including the same.

A transfer device according to an aspect of the invention includes: a first transfer belt; a first and second roller on which the first transfer belt is wound; a second transfer belt which makes contact with the first transfer belt; a third roller on which the second transfer belt is wound, and which makes contact with the first roller via the first transfer belt and the second transfer belt; a fourth roller on which the second transfer belt is wound, and which makes contact with the second roller via the first transfer belt and the second transfer belt; a first drive force transmission mechanism which transmits a drive force to the first roller; and a second drive force transmission mechanism which transmits a drive force to the third roller. As a long nip is formed by the first transfer belt and the second transfer belt, enhancing a transfer performance and, even in the event that a contact pressure changes, the second transfer belt is driven by the second drive force transmission mechanism, it is possible to obtain a stable drive of the second transfer belt in the long nip and, it not happening that toner or carrier components are deposited at a nip entrance, it is possible to obtain a high transfer efficiency.

The transfer device according to the aspect of the invention may further include: a drive force controller which controls the second drive force transmission mechanism in such a way that a relationship between a belt movement speed V2 of the second transfer belt and a belt movement speed V1 of the first transfer belt is V2/V1=a (where a is a constant of 1 or less). In the event that the movement speed of the first transfer belt changes due to a change in transfer pressure or the like, by controlling the movement speed of the second transfer belt so as to maintain constant a ratio of the movement speed of the second transfer belt to the movement speed of the first transfer belt, an adhesion of the second transfer belt and a transfer material in a long nip portion being increased, it is possible to obtain the high transfer efficiency.

In the transfer device according to the aspect of the invention, the second drive force transmission mechanism may have a pulse motor, and the drive force controller controls the pulse motor by means of an input pulse. The movement speed of the second transfer belt being easily controlled in accordance with the change in transfer pressure, it is possible to maintain constant the ratio of the movement speed of the second transfer belt to the movement speed of the first transfer belt.

The transfer device according to the aspect of the invention may still further include: a variable contact pressure mechanism which makes variable a contact pressure of the third roller against the first roller via the first transfer belt and the second transfer belt, or a contact pressure of the fourth roller against the second roller via the first transfer belt and the second transfer belt; and a contact pressure controller which controls the variable contact pressure mechanism. It is possible to change the transfer pressure depending on a type of the transfer material.

In the transfer device according to the aspect of the invention, the second drive force transmission mechanism may have a one-way clutch. In a case in which the transfer material is interposed in the long nip, depending on a paper type, it may happen that, due to a friction coefficient between the second transfer belt and the transfer material being relatively high, the second transfer belt is stably moved in conjugation with the first transfer belt and, in this kind of case, on applying a drive force to the second transfer belt, the drive force conflicting with the stable conjoined movement, a behavior of the second transfer belt becomes unstable. In order to solve this kind of problem, by disposing the one-way clutch in the second drive force transmission mechanism which applies the drive force to the second transfer belt, in the event that the second transfer belt is moved, the drive force from the second drive force transmission mechanism is interrupted, and it is possible to obtain a stable belt behavior.

The transfer device according to the aspect of the invention may still further include: a bias application unit which applies a transfer bias to the third roller, wherein the first roller is grounded. By applying the transfer bias at a long nip entrance, it is possible to increase the transfer efficiency.

The transfer device according to the aspect of the invention may still further include: a cleaning member which abuts with the second transfer belt. Even in the event that a load is increased due to the abutment of the cleaning member, as the second transfer belt is driven by the second drive force transmission mechanism, it being possible to obtain a stable drive of the second transfer belt in the long nip, it is possible to obtain a long nip for obtaining a good transfer efficiency.

Also, an image forming apparatus according to an aspect of the invention includes: an image carrier on which a latent image is formed; a developing unit which develops the latent image with a liquid developer; a first transfer belt to which an image developed by the developing unit is transferred; a first and second rollers on which the first transfer belt is wound; a second transfer belt which makes contact with the first transfer belt; a third roller on which the second transfer belt is wound, and which makes contact with the first roller via the first transfer belt and the second transfer belt; a fourth roller on which the second transfer belt is wound, and which makes contact with the second roller via the first transfer belt and the second transfer belt; a first drive force transmission mechanism which transmits a drive force to the first roller; and a second drive force transmission mechanism which transmits a drive force to the third roller. As a long nip is formed by the first transfer belt and the second transfer belt, enhancing a transfer performance and, even in the event that a contact pressure changes, the second transfer belt is driven by the second drive force transmission mechanism, it being possible to obtain a long nip for obtaining a good efficiency of transferring a liquid developer image, an adhesion of the second transfer belt and a transfer material such as paper in a long nip portion being increased so as to obtain a high transfer efficiency, it is possible to obtain a high quality image.

The image forming apparatus according to the aspect of the invention may further include: a drive force controller which controls the second drive force transmission mechanism in such a way that a relationship between a belt movement speed V2 of the second transfer belt and a belt movement speed V1 of the first transfer belt is V2/V1=a (where a is a constant of 1 or less). In the event that the movement speed of the first transfer belt changes due to a change in transfer pressure or the like, by controlling the movement speed of the second transfer belt so as to maintain constant a ratio of the movement speed of the second transfer belt to the movement speed of the first transfer belt, the adhesion of the second transfer belt and the transfer material in the long nip portion being increased, it is possible to obtain the high transfer efficiency.

In the image forming apparatus according to the aspect of the invention, the second drive force transmission mechanism may have a pulse motor, and the drive force controller controls the pulse motor by means of an input pulse. The movement speed of the second transfer belt being easily controlled in accordance with the change in transfer pressure, it is possible to maintain constant the ratio of the movement speed of the second transfer belt to the movement speed of the first transfer belt.

The image forming apparatus according to the aspect of the invention may still further include: a variable contact pressure mechanism which makes variable a contact pressure of the third roller against the first roller via the first transfer belt and the second transfer belt, or a contact pressure of the fourth roller against the second roller via the first transfer belt and the second transfer belt; and a contact pressure controller which controls the variable contact pressure mechanism. It is possible to change the transfer pressure depending on a type of the transfer material.

The image forming apparatus according to the aspect of the invention may still further include: a media type information input unit, wherein in accordance with media type information input into the media type information input unit, the second drive force transmission mechanism is controlled by the drive force controller. The relationship between the movement speed of the second transfer belt and the movement speed of the first transfer belt being maintained corresponding to a change in movement distance due to a change in a media type, it is possible to obtain the high transfer efficiency.

The image forming apparatus according to the aspect of the invention may still further include: a media type information input unit, wherein in accordance with media type information input into the media type information input unit, the variable contact pressure mechanism is controlled by the contact pressure controller. A surface property varies depending on the media type and, as a low transfer pressure suffices for a transfer material having a smooth surface, while a transfer material having a rough surface requires a high transfer pressure, it is possible to apply a transfer pressure corresponding to the media type.

The image forming apparatus according to the aspect of the invention may still further include: a bias application unit which applies a transfer bias to the third roller, whereby the first roller is grounded. By applying the transfer bias at a long nip entrance, it is possible to increase the transfer efficiency.

In the image forming apparatus according to the aspect of the invention, the second drive force transmission mechanism may have a one-way clutch. In a case in which the transfer material is interposed in the long nip, depending on the media type, it may happen that, due to a friction coefficient between the second transfer belt and the transfer material being relatively high, the second transfer belt is stably moved in conjugation with the first transfer belt and, in this kind of case, on applying a drive force to the second transfer belt, the drive force conflicting with the stable conjoined movement, a behavior of the second transfer belt becomes unstable. In order to solve this kind of problem, by disposing the one-way clutch in the second drive force transmission mechanism which applies the drive force to the second transfer belt, in the event that the second transfer belt is moved, the drive force from the second drive force transmission mechanism is interrupted, and it is possible to obtain a stable belt behavior.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, using the drawings, a description will be given of a best mode for implementing the invention.

Figure 1:
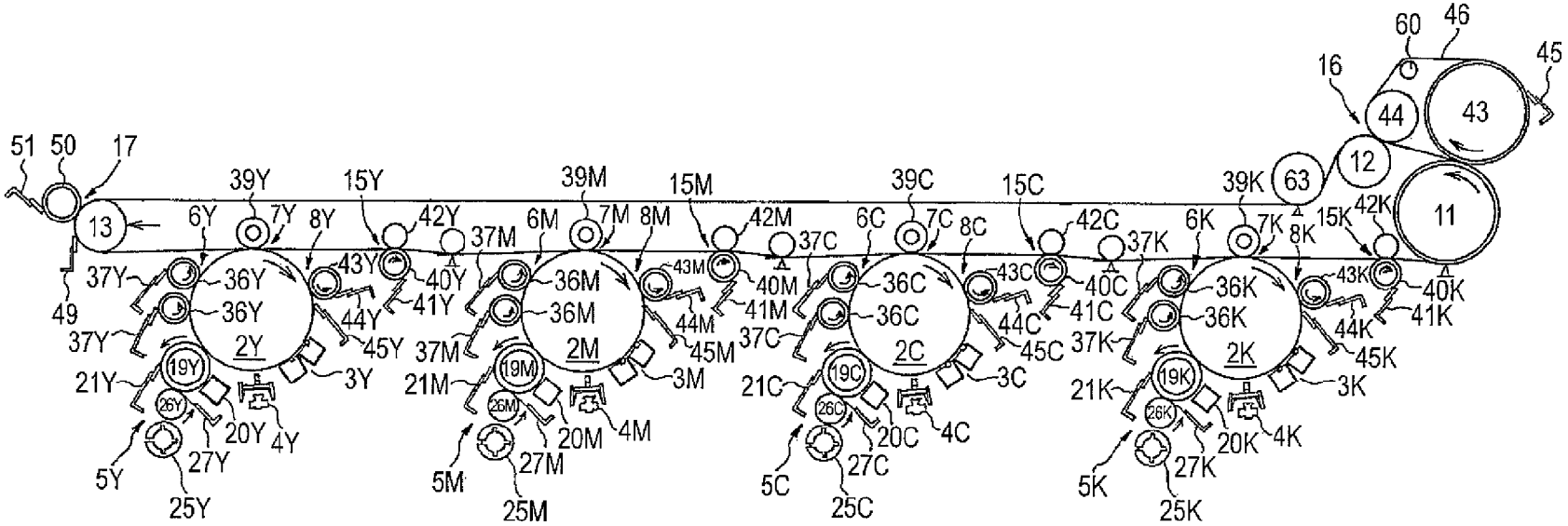
FIG. 1 is a diagram showing an embodiment of the invention.

FIG. 1 is a diagram schematically or partially showing one example of an embodiment of an image forming apparatus according to an aspect of the invention.

As shown in FIG. 1, the image forming apparatus 1 of the example includes photoreceptors 2Y, 2M, 2C and 2K, disposed in tandem, which are latent image carriers of yellow Y, magenta M, cyan C and black K. Herein, in the photoreceptors 2Y, 2M, 2C and 2K, 2Y represents a yellow photoreceptor, 2M a magenta photoreceptor, 2C a cyan photoreceptor, and 2K a black photoreceptor. Also, in other members too, in the same way, Y, M, C or K for each color is affixed to a reference numeral of each corresponding member, representing members of the individual colors. Each of the photoreceptors 2Y, 2M, 2C and 2K, in the example shown in FIG. 1, is configured of a photoreceptor drum. It is also possible to configure each photoreceptor 2Y, 2M, 2C and 2K in an endless belt form.

The photoreceptors 2Y, 2M, 2C and 2K are all arranged in such a way as to, when actuated, rotate clockwise, as shown by arrows in FIG. 1. Charging members 3Y, 3M, 3C and 3K, exposure devices 4Y, 4M, 4C and 4K, developing devices 5Y, 5M, 5C and 5K, photoreceptor squeeze devices 6Y, GM, 6C and 6K, primary transfer devices 7Y, 7M, 7C and 7K, and photoreceptor cleaning devices 8Y, 8M, 8C and 8K are disposed on peripheries of the photoreceptors 2Y, 2M, 2C and 2K, respectively, in order from an upstream side in their rotation direction.

Also, the image forming apparatus 1 includes an endless intermediate transfer belt 10 which is an intermediate transfer medium. The intermediate transfer belt 10, being stretched over a belt drive roller 11, to which a drive force of a motor is transmitted, and a pair of driven rollers 12 and 13, is provided in such a way as to be rotatable counterclockwise in FIG. 1. In this case, the belt drive roller 11 and one driven roller 12 are adjacently spaced a predetermined distance away from each other in a moving direction, indicated by an arrow, of a transfer material such as paper conveyed to them. Also, the belt drive roller 11 and the other driven roller 13 are spaced apart from each other in a direction of the tandem disposition of the photoreceptors 2Y, 2M, 2C and 2K. Furthermore, the intermediate transfer belt 10 is arranged in such a way that, by a tension being placed on the driven roller 13 in a direction of an arrow, a looseness is eliminated. Also, the moving direction of the intermediate transfer belt 10 is changed by a press roller 63 disposed in a vicinity of the driven roller 12.

The intermediate transfer belt 10 has a multilayer structure in which an elastic layer is laminated to a base material layer, and a coating layer is formed on a surface of the elastic layer. By adopting the multilayer structure including the elastic layer, the intermediate transfer belt 10 being provided with an appropriate elasticity in a direction of thickness, a transferability of liquid developer images from the photoreceptors 2Y, 2M, 2C and 2K, and a transferability to the transfer material, are improved, and particularly, a transferability to large irregularities being superior, it is possible to transfer a beautiful image even to concave portion. A material configuring the base material layer is a polyimide resin, a polyamide-imide resin or the like, a material configuring the elastic layer is polyurethane rubber or the like, and a material configuring the coating layer is a fluorine resin. As the intermediate transfer belt 10, it is also acceptable to employ one of a single layer structure.

In the image forming apparatus 1 of the example, the photoreceptors 2Y, 2M, 2C and 2K and the developing devices 5Y, 5M, 5C and 5K are disposed in the order of the colors Y, M, C and K from the upstream side in the direction of the rotation of the intermediate transfer belt 10, but it is possible to optionally set the order of the disposition of the colors Y, M, C and K.

Intermediate transfer belt squeeze devices 15Y, 15M, 15C and 15K are disposed respectively in vicinities of the primary transfer devices 7Y, 7M, 7C and 7K on a downstream side of the primary transfer devices 7Y, 7M, 7C and 7K in the direction of the rotation of the intermediate transfer belt 10. Furthermore, a secondary transfer device 16 is provided on a belt drive roller 11 side of the intermediate transfer belt 10, and an intermediate transfer belt cleaning device 17 is provided on a driven roller 13 side of the intermediate transfer belt 10.

Although not shown in the figure, the image forming apparatus 1 of the example, in the same way as a heretofore known general image forming apparatus, includes a transfer material storage device, which stores a transfer material such as, for example, paper, and a register roller pair, which conveys and feeds the transfer material from the transfer material storage device to the secondary transfer device 16, on an upstream side of the secondary transfer device 16 in a transfer material conveyance direction. Also, the image forming apparatus 1, in the same way, includes a fixing device and a discharge tray on a downstream side of the secondary transfer device 16 in the transfer material conveyance direction.

Each of the charging members 3Y, 3M, 3C and 3K is formed of, for example, a pair of corona chargers. A bias of the same polarity as a charge polarity of a liquid developer is applied to each of the charging members 3Y, 3M, 3C and 3K from an unshown power supply. Then, the charging members 3Y, 3M, 3C and 3K are arranged in such a way as to charge the corresponding photoreceptors 2Y, 2M, 2C and 2K, respectively. Also, each of the exposure devices 4Y, 4M, 4C and 4K is arranged in such a way as to, by applying a laser beam onto each corresponding charged photoreceptor 2Y, 2M, 2C and 2K from, for example, a laser scanning optical system or the like, form an electrostatic latent image.

The developing devices 5Y, 5M, 5C and 5K respectively include developer supply units (not shown), developing rollers 19Y, 19M, 19C and 19K, toner charging corona chargers 20Y, 20M, 20C and 20K, and developing roller cleaners 21Y, 21M, 21C and 21K.

The developer supply units respectively include developer containers, which contain liquid developers configured of toner particles and nonvolatile liquid carriers, developer pumping rollers 25Y, 25M, 25C and 25K, anilox rollers 26Y, 26M, 26C and 26K, and developer regulation blades 27Y, 27M, 27C and 27K.

In the liquid developer contained in each developer container, as a toner, it is possible to use particles, having an average particle diameter of, for example, 1 μm, in which a colorant such as a heretofore known pigment used in the toner is dispersed in a similarly heretofore known thermoplastic resin. Meanwhile, as a liquid carrier, in a case of a low viscosity and low concentration liquid developer, it is possible to use an insulating liquid carrier such as, for example, Isopar (trademark: Exxon Mobil Corporation). Also, as a liquid carrier, in a case of a high viscosity and high concentration liquid developer, it is possible to use an insulating liquid carrier such as, for example, an organic solvent, silicone oil, such as phenylmethylsiloxane, dimethylpolysiloxane, or polydimethyl cyclosiloxane, having a flash point of 210° C. or higher, mineral oil, aliphatic saturated hydrocarbon such as relatively low viscosity liquid paraffin having a boiling point of 170° C. or higher and a viscosity of 3 mPa·s at 40° C., normal paraffin; vegetable oil, food oil, or higher fatty acid ester. Then, liquid developers 23Y, 23M, 23C and 23K are ones in which the toner particles are added to the liquid carrier together with a dispersant, making a toner solid content concentration approximately 20%.

Each of the developer pumping rollers 25Y, 25M, 25C and 25K is a roller which pumps the liquid developer in the developer container and supplies it to each anilox roller 26Y, 26M, 26C and 26K. The developer pumping rollers 25Y, 25M, 25C and 25K are all arranged in such a way as to rotate in a clockwise direction shown by arrows in FIG. 1. Also, each of the anilox rollers 26Y, 26M, 26C and 26K is a roller which, being a cylindrical member, has spiral grooves formed microscopically and uniformly in a surface. Dimensions of the grooves are set at a groove pitch of, for example, approximately 170 μm and a groove depth of, for example, approximately 30 μm. Of course, the dimensions of the grooves are not limited to these values. The anilox rollers 26Y, 26M, 26C and 26K are all arranged in such a way as to rotate in a counterclockwise direction shown by arrows in FIG. 1, which is the same as a direction in which the developing rollers 19Y, 19M, 19C and 19K rotate. It is also possible to arrange in such a way that the anilox rollers 26Y, 26M, 26C and 26K all corotate with the developing rollers 19Y, 19M, 19C and 19K. That is, the rotation direction of the anilox rollers 26Y, 26M, 26C and 26K is not limiting, but optional.

The developer regulation blades 27Y, 27M, 27C and 27K are provided respectively in contact with the surfaces of the anilox rollers 26Y, 26M, 26C and 26K. Each of the developer regulation blades 27Y, 27M, 27C and 27K is configured of a rubber portion which, being made of urethane rubber or the like, makes contact with the surface of each respective anilox roller 26Y, 26M, 26C and 26K, and a plate which, being made of metal or the like, supports the rubber portion. Each of the developer regulation blades 27Y, 27M, 27C and 27K, using the rubber portion, scrapes off and removes a liquid developer adhering to a surface other than the grooves of each respective anilox roller 26Y, 26M, 26C and 26K. Consequently, each anilox roller 26Y, 26M, 26C and 26K is arranged in such a way as to supply only a liquid developer adhering inside its grooves to each respective developing roller 19Y, 19M, 19C and 19K.

Each of the developing rollers 19Y, 19M, 19C and 19K is one which, being a cylindrical member having a width of, for example, approximately 320 mm, includes an elastic body, such as conductive urethane rubber, and a resin layer or a rubber layer, on an outer periphery of a metal shaft made of, for example, iron or the like. The developing rollers 19Y, 19M, 19C and 19K are arranged in such a way as to be brought into contact with the photoreceptors 2Y, 2M, 2C and 2K, respectively, and rotate counterclockwise, as shown by arrows in FIG. 1.

Each of the toner charging corona chargers 20Y, 20M, 20C and 20K is arranged in such a way as to have a voltage applied thereto and charge each corresponding developing roller 19Y, 19M, 19C and 19K.

Furthermore, the developing roller cleaners 21Y, 21M, 21C and 21K, being configured of, for example, rubber or the like which makes contact with surfaces of the corresponding developing rollers 19Y, 19M, 19C and 19K, are ones for scraping off and removing developers remaining on the developing rollers 19Y, 19M, 19C and 19K, respectively.

The photoreceptor squeeze devices 6Y, 6M, 6C and 6K respectively include pairs of photoreceptor squeeze rollers 36Y, 36M, 36C and 36K, and photoreceptor squeeze roller cleaners 37Y, 37M, 37C and 37K. Each of the photoreceptor squeeze rollers 36Y, 36M, 36C and 36K is disposed on a downstream side of a contact portion (a nip portion) between each photoreceptor 2Y, 2M, 2C and 2K and each developing roller 19Y, 19M, 19C and 19K in the rotation direction of each photoreceptor 2Y, 2M, 2C and 2K. Then, each of the photoreceptor squeeze rollers 36Y, 36M, 36C and 36K is arranged in such a way as to be rotated in a direction (a counterclockwise direction in FIG. 1) opposite to that of each photoreceptor 2Y, 2M, 2C and 2K, and remove a liquid carrier on each photoreceptor 2Y, 2M, 2C and 2K.

An elastic roller, in which an elastic member made of conductive urethane rubber or the like, and a superficial layer made of a fluorine resin, are disposed on a surface of a cored bar made of metal, is suitable as each photoreceptor squeeze roller 36Y, 36M, 36C and 36K. Also, each of the photoreceptor squeeze roller cleaners 37Y, 37M, 37C and 37K is one which, being made of an elastic body such as rubber, is abutted with a surface of each corresponding photoreceptor squeeze roller 36Y, 36M, 36C and 36K, and scrapes off and removes a liquid carrier remaining on each relevant squeeze roller 36Y, 36M, 36C and 36K.

The primary transfer devices 7Y, 7M, 7C and 7K respectively include primary transfer backup rollers 39Y, 39M, 39C and 39K which bring the intermediate transfer belt 10 into contact with the photoreceptors 2Y, 2M, 2C and 2K. Each backup roller 39Y, 39M, 39C and 39K has a voltage of, for example, approximately −200V, which has a polarity opposite to a charge polarity of toner particles, applied thereto, and primarily transfers a toner image (a liquid developer image) of a color on each photoreceptor 2Y, 2M, 2C and 2K to the intermediate transfer belt 10.

The photoreceptor cleaning devices 8Y, 8M, 8C and 8K include photoreceptor cleaning rollers 43Y, 43M, 43C and 43K, photoreceptor cleaning roller cleaners 44Y, 44M, 44C and 44K, and photoreceptor cleaning blades 45Y, 45M, 45C and 45K, which are disposed respectively on the photoreceptors 2Y, 2M, 2C and 2K after the primary transfer.

The intermediate transfer belt squeeze devices 15Y, 15M, 15C and 15K respectively include intermediate transfer belt squeeze rollers 40Y, 40M, 40C and 40K, intermediate transfer squeeze backup rollers 42Y, 42M, 42C and 42K, and intermediate transfer belt squeeze roller cleaners 41Y, 41M, 41C and 41K. Each of the intermediate transfer belt squeeze rollers 40Y, 40M, 40C and 40K collects a liquid carrier of a corresponding color on the intermediate transfer belt 10. Also, the intermediate transfer belt squeeze roller cleaners 41Y, 41M, 41C and 41K scrape the collected liquid carriers on the intermediate transfer belt squeeze rollers 40Y, 40M, 40C and 40K, respectively. Each of the intermediate transfer belt squeeze roller cleaners 41Y, 41M, 41C and 41K, in the same way as each squeeze roller cleaner 37Y, 37M, 37C and 37K, is made of an elastic body such as rubber.

The intermediate transfer belt cleaning device 17 disposed on the driven roller 13 side of the intermediate transfer belt 10 includes an intermediate transfer belt cleaning roller 50, an intermediate transfer belt cleaning roller cleaner 51, and an intermediate transfer belt cleaning blade 49.

The toner images on the intermediate transfer belt 10 are transferred to the transfer material by the secondary transfer device 16. The color toner images transferred to the transfer material are fixed by an unshown fixer in the same way as heretofore known, the transfer material on which a full color fixed image has been formed is conveyed to the discharge tray, and a color image forming operation finishes.

A detailed description will be given of the secondary transfer device 16 which is a characteristic configuration of an embodiment of the invention. The secondary transfer device 16 includes a pair of secondary transfer rollers spaced a predetermined distance away from each other in the transfer material moving direction. A secondary transfer roller, among the pair of secondary transfer rollers, disposed on an upstream side in the transfer material moving direction is a first secondary transfer roller 43. Also, a secondary transfer roller, among the pair of secondary transfer rollers, disposed on a downstream side in the transfer material moving direction is a second secondary transfer roller 44. Then, an endless transfer material conveyance belt 46 is stretched over the first and second secondary transfer rollers 43 and 44. In this case, a tension is placed on the transfer material conveyance belt 46 by a tension roller 60. Also, the first and second secondary transfer rollers 43 and 44 are arranged in such a way as to be able to make contact with the belt drive roller 11 and the driven roller 12, respectively, via the intermediate transfer belt 10 and the transfer material conveyance belt 46. The transfer material conveyance belt 46 is made of a polyimide resin or a polyamide-imide resin.

That is, the transfer material conveyance belt 46 stretched over the first and second secondary transfer rollers 43 and 44 is arranged in such a way as to, as well as putting the transfer material into adhesion with the intermediate transfer belt 10 stretched over the belt drive roller 11 and the driven roller 12, while conveying the transfer material in a condition in which it is in adhesion with the intermediate transfer belt 10, secondarily transfer a color toner image (a liquid developer image), in which the toner images of the individual colors on the intermediate transfer belt 10 are combined, to the transfer material.

In this case, the belt drive roller 11 and the driven roller 12 also function as backup rollers of the secondary transfer rollers 43 and 44, respectively, at a secondary transfer time. That is, the belt drive roller 11, in the secondary transfer device 16, is also used as a first backup roller disposed on an upstream side of the driven roller 12 in the transfer material moving direction. Also, the driven roller 12, in the secondary transfer device 16, is also used as a second backup roller disposed on a downstream side of the belt drive roller 11 in the transfer material moving direction. A secondary transfer bias application unit being provided in the first secondary transfer roller 43, a secondary transfer bias within a range of +600 to 2000V of a direct current voltage is applied to the first secondary transfer roller 43, and the other rollers 11, 12 and 44 are grounded.

Consequently, the transfer material conveyed to the secondary transfer device 16 has the secondary transfer bias applied thereto in a pressure contact starting position (a nip starting position) between the first secondary transfer roller 43 and the belt drive roller 11, and is put into adhesion with the intermediate transfer belt 10 in a predetermined movement area of the transfer material as far as a pressure contact finishing position (a nip finishing position) between the second secondary transfer roller 44 and the driven roller 12. As the full color toner image on the intermediate transfer belt 10, by this means, is secondarily transferred to the transfer material, which takes on a condition in which it is in adhesion with the intermediate transfer belt 10, over a predetermined time, it is possible to carry out a good secondary transfer.

Also, the secondary transfer device 16 includes a transfer belt cleaner 45 for the transfer material conveyance belt 46. The transfer belt cleaner 45, in the same way as the photoreceptor squeeze roller cleaners 37Y, 37M, 37C and 37K, is made of an elastic body such as rubber. Then, the transfer belt cleaner 45 is abutted with the transfer material conveyance belt 46, and scrapes off and removes a foreign substance, such as a liquid developer, remaining on a surface of the transfer material conveyance belt 46 after the secondary transfer. Consequently, it is possible to prevent an effect on a next transfer material due to a foreign substance, such as a liquid developer, adhering to the transfer material conveyance belt 46.

Furthermore, the first secondary transfer roller 43 is arranged in such a way as to be able to make contact with the belt drive roller 11 via the intermediate transfer belt 10 and the transfer material conveyance belt 46. By this means, when a transfer material starts entering a pressure contact position between the belt drive roller 11 and the first secondary transfer roller 43, the transfer material is put into reliable adhesion with the intermediate transfer belt 10, and the secondary transfer bias is applied. By this means, a transfer of a toner image to the transfer material from the intermediate transfer belt 10 is reliably started. Also, the secondary transfer bias is applied in the pressure contact position between the belt drive roller 11 and the first secondary transfer roller 43, and the transfer material to which the toner image on the intermediate transfer belt 10 has been transferred is nipped between the intermediate transfer belt 10 and the transfer material conveyance belt 46, it is possible to prevent the transfer material separating (coming off) from the intermediate transfer belt 10. Consequently, it is possible to carry out a still better transfer. Furthermore, the transfer material conveyance belt 46 is made parallel to the intermediate transfer belt 10 between a contact position between the first secondary transfer roller 43 and the belt drive roller 11, and a contact position between the second secondary transfer roller 44 and the driven roller 12. By this means, it is possible, while the transfer material moves between the contact positions, to put the transfer material into stable adhesion with the intermediate transfer belt 10. Consequently, as well as a transfer efficiency becoming still better, a transfer material convey ability is also further improved.

Furthermore, when the transfer material starts entering each of a pressure contact portion between the belt drive roller 11 and the first secondary transfer roller 43, and a pressure contact portion between the driven roller 12 and the second secondary transfer roller 44, both the intermediate transfer belt 10 and the transfer material conveyance belt 46 undergo a resistance, and each of them is apt to cause a looseness. Therein, a tension is placed on the intermediate transfer belt 10 with the driven roller 13 also used as a tension roller, and a tension is placed on the transfer material conveyance belt 46 with the tension roller 60 disposed thereon. By this means, even in the event that the intermediate transfer belt 10 and the transfer material conveyance belt 46 undergo the resistance and are apt to cause the looseness, the intermediate transfer belt 10 and the transfer material conveyance belt 46 are maintained under tension. Consequently, it is possible, between the pressure contact position between the belt drive roller 11 and first secondary transfer roller 43, and the pressure contact position between the driven roller 12 and the second secondary transfer roller 44, to efficiently carry out the transfer from the intermediate transfer belt 10 to the transfer material. Moreover, it is possible to stably and more reliably carry out a support and conveyance of the transfer material by the transfer material conveyance belt 46.

An arrangement is such that the transfer belt cleaner 45 is abutted with the transfer material conveyance belt 46, and scrapes off and removes a foreign substance, such as a liquid developer, remaining on the surface of the transfer material conveyance belt 46 after the secondary transfer. In this case, naturally, an increasing load for driving it is placed on the transfer material conveyance belt 46.

Figure 2:
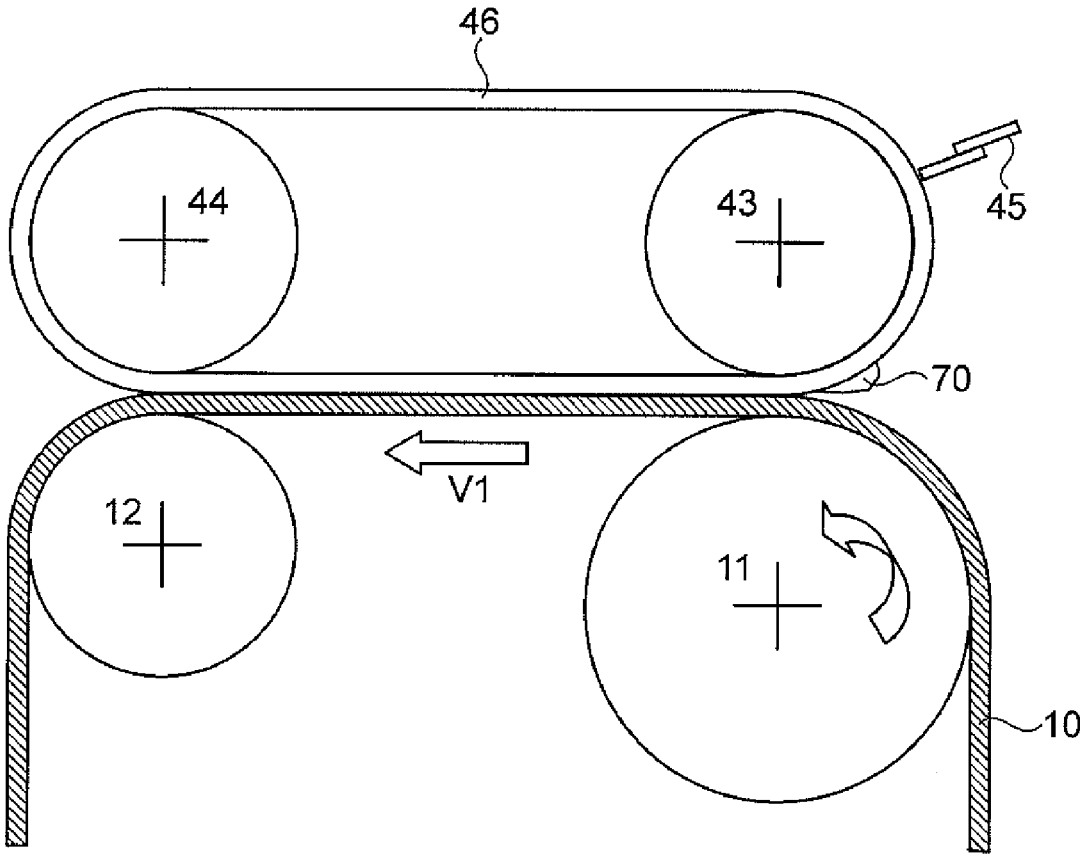
FIG. 2 is a diagram showing the embodiment of the invention.

FIG. 2 is a diagram showing a case in which the transfer material conveyance belt 46 is moved in conjunction with the intermediate transfer belt 10. The intermediate transfer belt 10 is driven by the belt drive roller 11 which is driven by an intermediate transfer belt drive force transmission mechanism 61, and the transfer material conveyance belt 46 is moved in conjunction with the intermediate transfer belt 10. In a transfer device using a liquid developer, as a carrier component is interposed between the intermediate transfer belt 10 and the transfer material conveyance belt 46, a friction coefficient between the two being reduced, there is a risk in that the transfer material conveyance belt 46 slips and cannot be stably moved. Unless the transfer material conveyance belt 46 is stably moved, as shown in FIG. 2, a condition occurs in which a toner or a carrier 70 is deposited at a nip entrance. As a result thereof, a problem occurs in that these deposits adhere to a leading extremity or underside of the transfer material.

Figure 3:
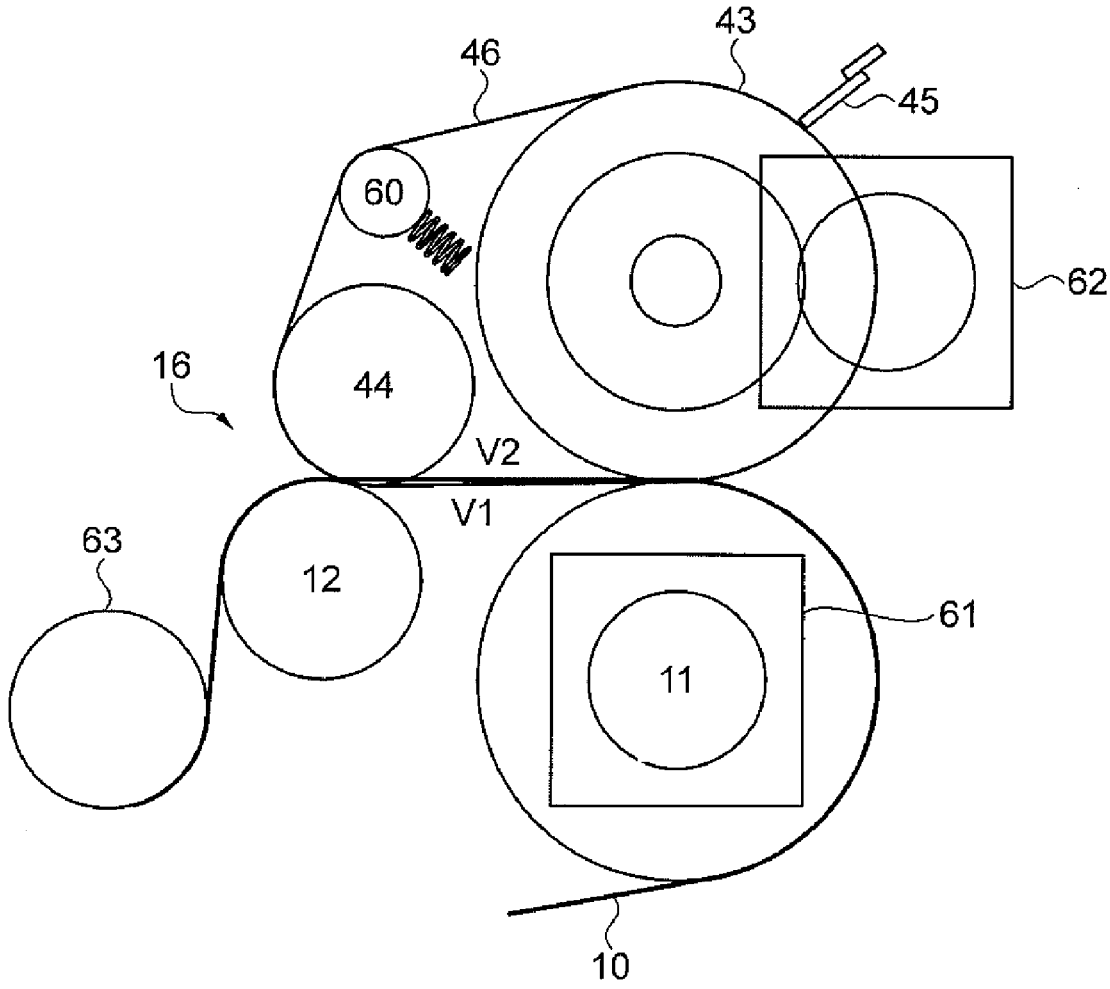
FIG. 3 is a diagram showing the embodiment of the invention.
Figure 4:
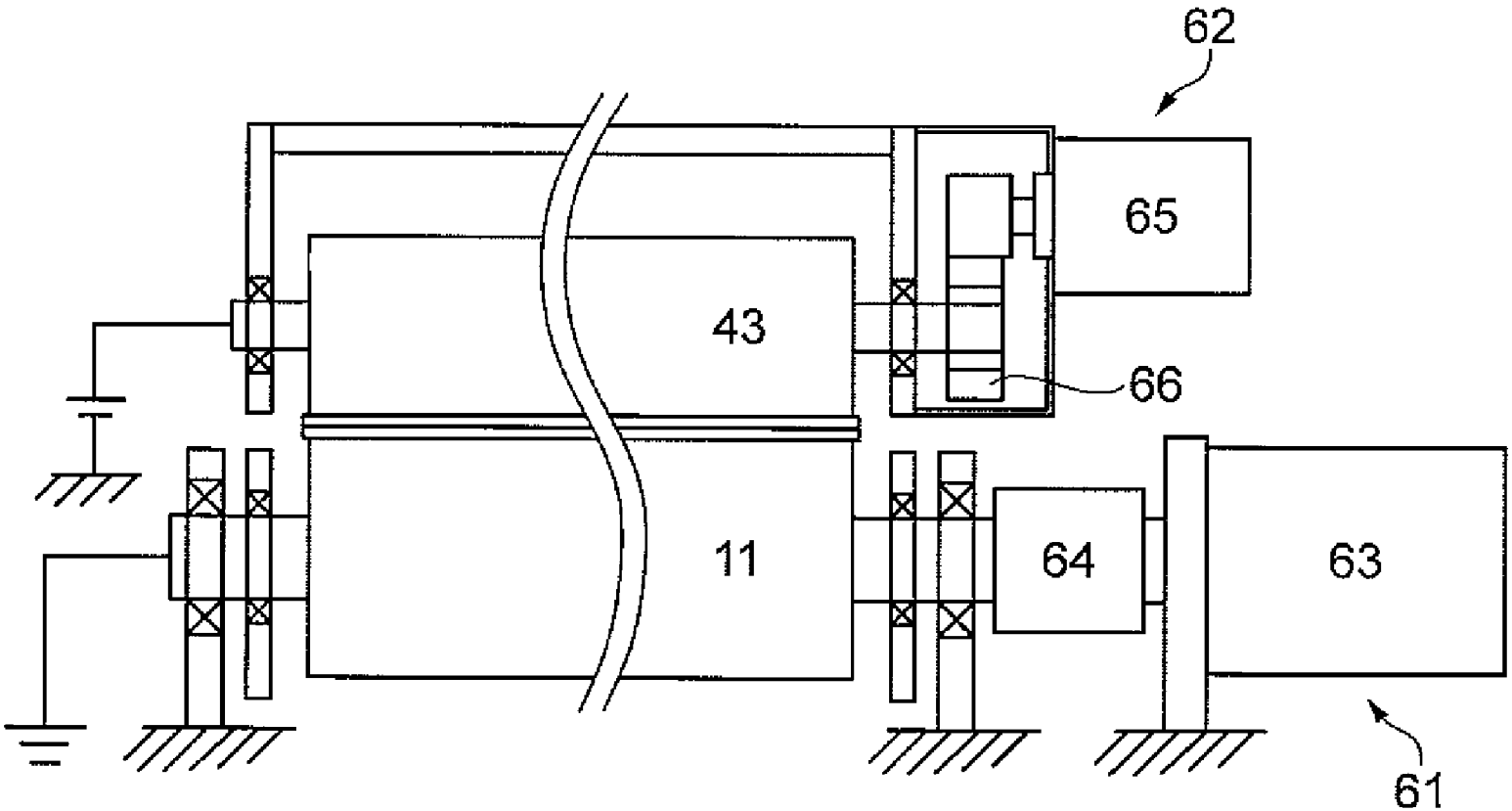
FIG. 4 is a diagram showing the embodiment of the invention.

FIGS. 3 and 4 are diagrams showing the secondary transfer device 16 of an embodiment of the invention. The secondary transfer device 16 of the embodiment of the invention includes the intermediate transfer belt drive force transmission mechanism 61, which transmits a drive force to the belt drive roller 11, and a transfer belt drive force transmission mechanism 62, which transmits a drive force to the first secondary transfer roller 43. In the intermediate transfer belt drive force transmission mechanism 61, an output shaft of a motor 63 is linked to a rotating shaft of the belt drive roller 11 via a decelerating mechanism 64. In the transfer belt drive force transmission mechanism 62, an output shaft of a pulse motor 65 is linked to a gear 66 disposed on a rotating shaft of the first secondary transfer roller 43. The transfer material conveyance belt 46 is driven by the transfer belt drive force transmission mechanism 62 of the first secondary transfer roller 42. By driving the transfer material conveyance belt 46 by means of the independent transfer belt drive force transmission mechanism 62 separate from the intermediate transfer belt drive force transmission mechanism, it is possible to stably drive the transfer material conveyance belt 46 without it being affected by the drive of the intermediate transfer belt 10.

At this time, in order to improve an adhesion of the transfer material and the transfer material conveyance belt 46, enhancing a transfer performance, a relationship between a belt movement speed V2 of the transfer material conveyance belt 46 and a belt movement speed V1 of the intermediate transfer belt 10 is taken to be V2/V1=a (where a is a constant of 1 or less).

Also, a surface property of a transfer material varies, and a secondary transfer pressure caused when carrying out the secondary transfer also varies, depending on a type of the transfer material. For example, a small secondary transfer pressure suffices for a transfer material having a smooth surface, while a large secondary transfer pressure is required for a transfer material having a rough surface.

Figure 5:
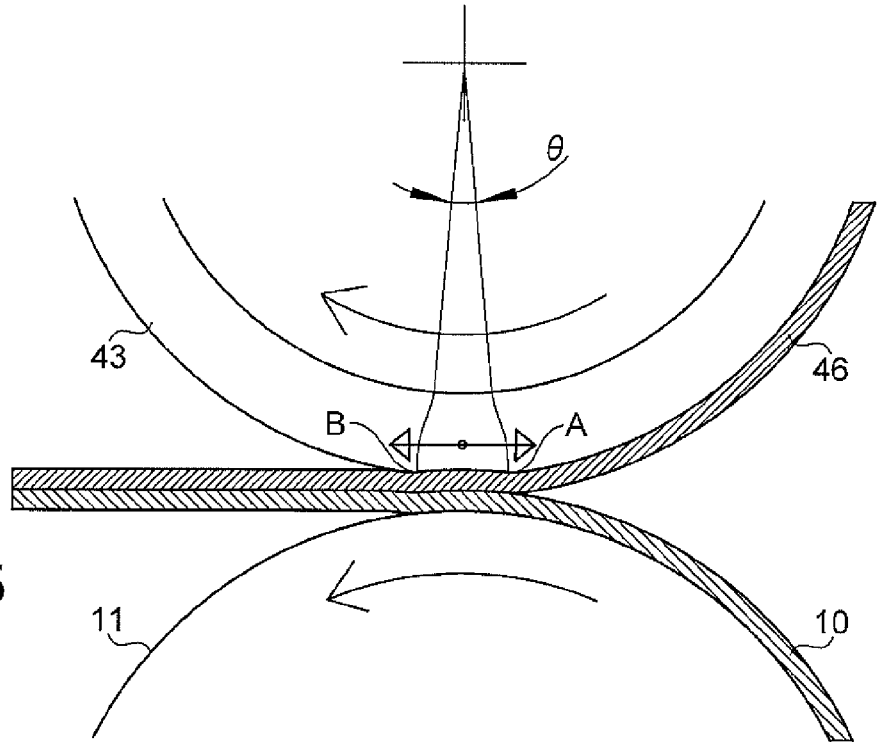
FIG. 5 is a diagram showing the embodiment of the invention.
Figure 6:
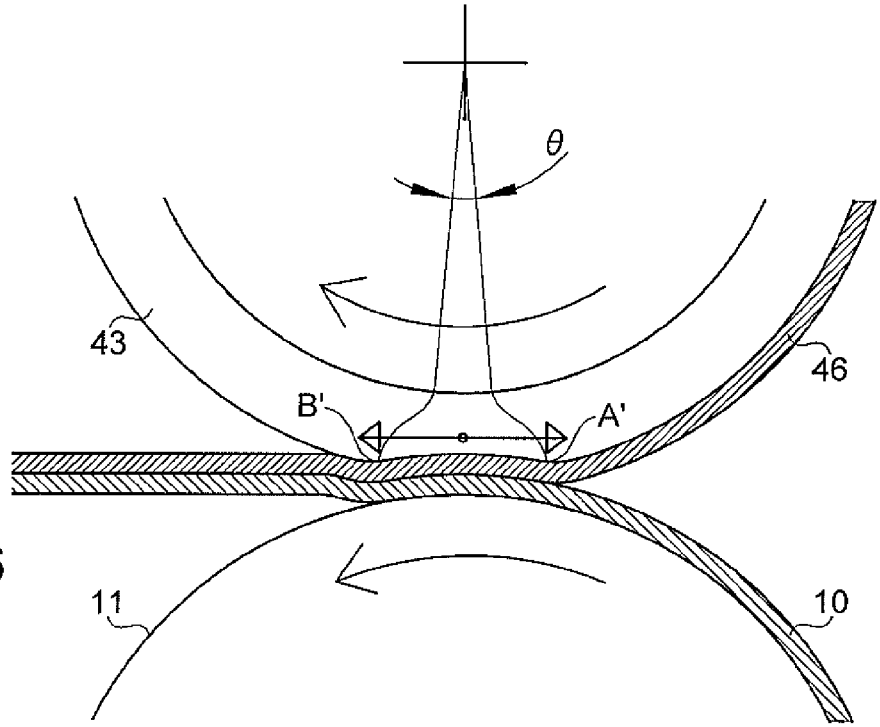
FIG. 6 is a diagram showing the embodiment of the invention.

By changing a secondary transfer pressure depending on the type of the transfer material, the kind of change shown in FIGS. 5 and 6 occurs. FIG. 5 is a diagram showing a case in which the secondary transfer pressure is low, and FIG. 6 is a diagram showing a case in which the secondary transfer pressure is high. In the secondary transfer device 16 of the embodiment of the invention, a hardness of the belt drive roller 11 is made higher than a hardness of the first secondary transfer roller 43. This is because, by making the hardness of the first secondary transfer roller 43, on which the transfer material conveyance belt 46 is wound, lower than the hardness of the belt drive roller 11 on which the intermediate transfer belt 10 is wound, an adhesion of the transfer material and the transfer material conveyance belt 46 in a long nip portion is improved, obtaining a high transfer efficiency.

An amount of surface deformation of the first secondary transfer roller 43 differs between the case in which the secondary transfer pressure is low and the case in which it is high, and a movement distance of the transfer material conveyance belt 46 in adhesion with it changes due to the surface deformation. The transfer belt drive force transmission mechanism 62 is controlled in order to maintain the relationship of V2/V1=a (where a is a constant of 1 or less) despite the change in the movement distance of the transfer material conveyance belt 46 due to the change in the secondary transfer pressure. A motor input pulse quantity of the pulse motor 65 of the transfer belt drive force transmission mechanism 62 is changed, controlling the belt movement speed V2 of the transfer material conveyance belt 46. A secondary transfer pressure and a motor input pulse quantity corresponding to a kind of the transfer material are shown in Table 1.

TABLE 1

| Transfer material type | Secondary transfer pressure | Motor input pulse quantity |
|---|---|---|
| Coated paper | 300 N | 15022 |
| Plain paper | 500 N | 14948 |
| Special paper | 1200 N | 14799 |

In the above mentioned Table 1, a relationship between the secondary transfer pressures is coated paper<plain paper<special paper, and a relationship between the motor input pulse quantities is coated paper>plain paper>special paper. It is preferable to arrange in such a way that, on selecting a type of the transfer material from on a driver, a secondary transfer pressure and a motor input pulse quantity are automatically set.

Figure 7:
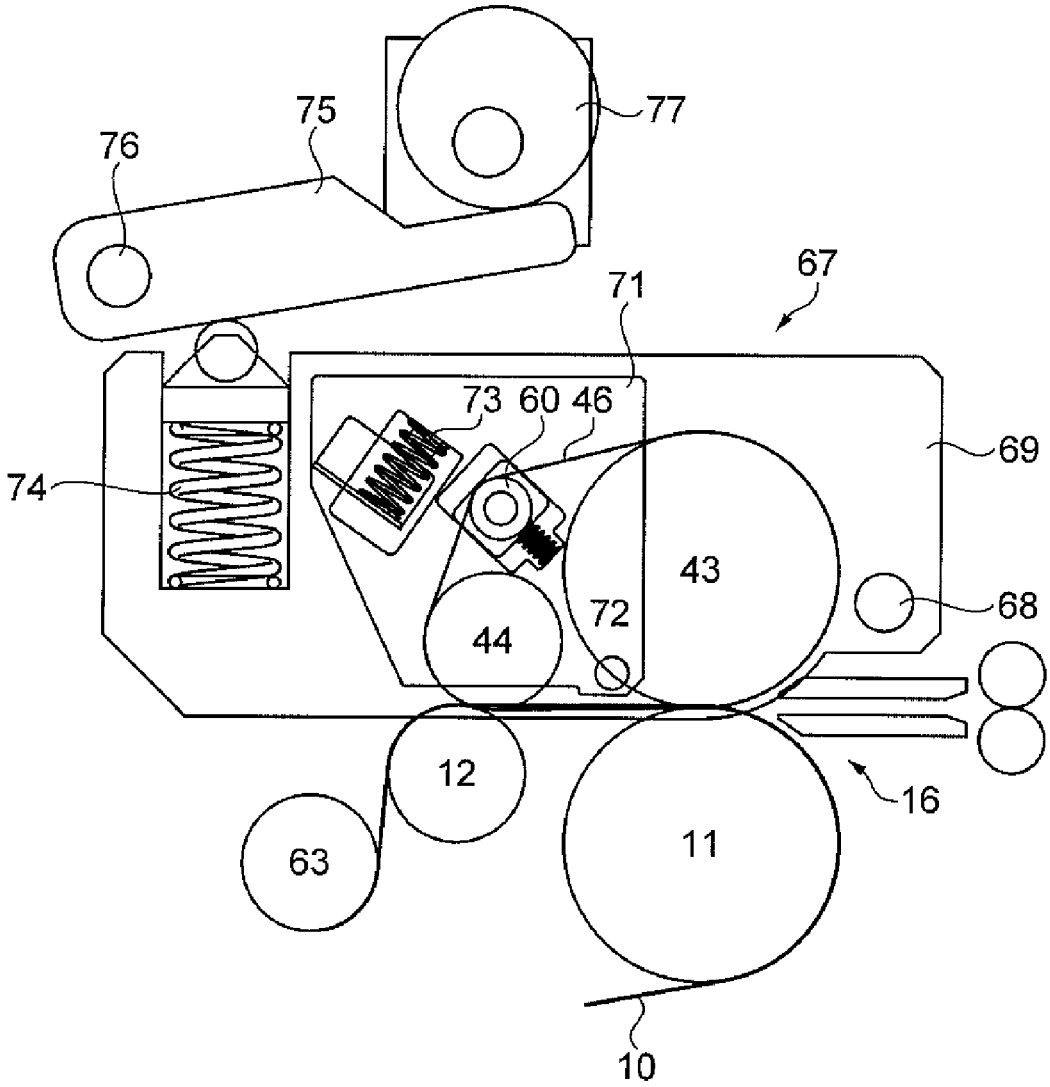
FIG. 7 is a diagram showing the embodiment of the invention.
Figure 8:
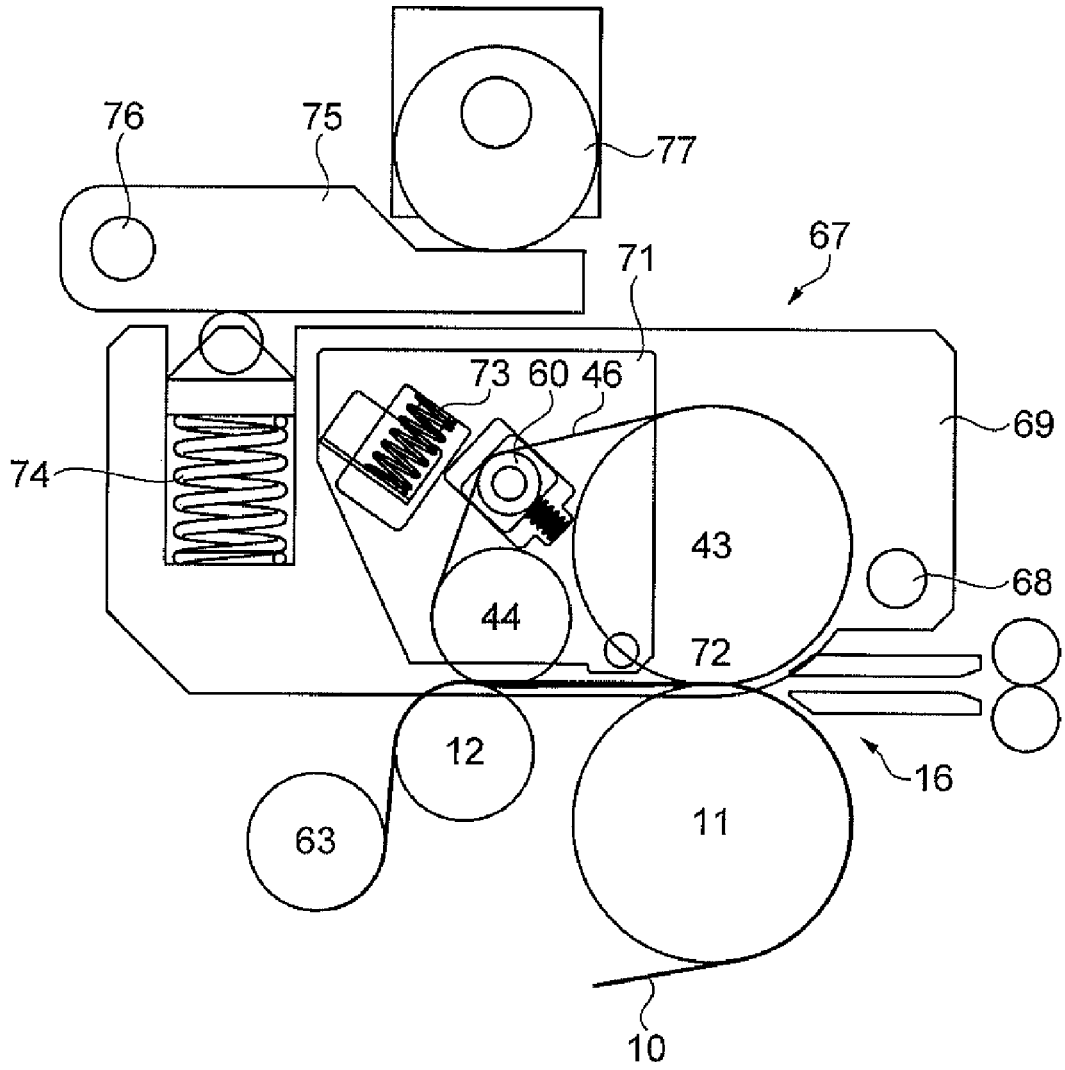
FIG. 8 is a diagram showing the embodiment of the invention.

FIGS. 7 and 8 are diagrams showing a variable secondary transfer pressure mechanism 67 which makes variable the secondary transfer pressure of the secondary transfer device 16.

A first frame 69 is pivotally supported by a pin 68. A second frame 71 is pivotally supported on the first frame 69 by a pin 72. A spring 73, being disposed between the second frame 71 and the first frame 69, urges the second frame 71 towards the driven roller 12. The first secondary transfer roller 43 is supported on the first frame 69. The second secondary transfer roller 44 and the tension roller 60 are supported on the second frame 71. The transfer material conveyance belt 46 is wound around the first secondary transfer roller 43, the second secondary transfer roller 44, and the tension roller 60.

An actuating lever 75 pivotally supported by a pin 76 is disposed in a vicinity of the first frame 69. A spring 74 is disposed on the first frame 69, and the spring 74 urges the actuating lever 75 in a direction in which the secondary transfer pressure is reduced (the actuating lever 75 is pivoted counterclockwise about the pin 76). A cam 77 abuts with the actuating lever 75. The actuating lever 75 is pivoted about the pin 76 by means of a rotation of the cam 77.

FIG. 7 shows a condition in which the actuating lever 75 is positioned in a direction in which the secondary transfer pressure is reduced by the spring 74 disposed on the first frame 69. FIG. 8 shows a condition in which the actuating arm 75 is pressed by means of the rotation of the cam 77, and positioned in a direction in which the secondary transfer pressure is increased against an urging force of the spring 74 disposed on the first frame 69.

In a case in which the transfer material is interposed in a long nip between the intermediate transfer belt 10 and the transfer material conveyance belt 46, depending on a media type, it may happen that, due to a friction coefficient between the transfer material conveyance belt 46 and the transfer material being relatively high, the transfer material conveyance belt 46 is stably moved in conjunction with the intermediate transfer belt 10 and, in this kind of case, on applying a drive force to the transfer material conveyance belt 46, the drive force conflicting with the stable conjoined movement, a behavior of the transfer material conveyance belt 46 becomes unstable. In order to solve this kind of problem, by disposing a one-way clutch in the transfer belt drive force transmission mechanism 62 of the first secondary transfer roller 43 which applies a drive force to the transfer material conveyance belt 46, in the event that the transfer material conveyance belt 46 is moved, the drive force from the transfer belt drive force transmission mechanism 62 is interrupted, and it is possible to obtain a stable belt behavior.

As heretofore described, according to the transfer device of the embodiment of the invention, even in the event that the movement speed V1 of the intermediate transfer belt 10 changes due to a change in transfer pressure or the like, by controlling the movement speed V2 of the transfer material conveyance belt 46, and maintaining a ratio of the movement speed of the transfer material conveyance belt 46 to the movement speed of the intermediate transfer belt 10 at V2/V1=a (where a is a constant of 1 or less), it is possible to increase the adhesion of the transfer material conveyance belt and the transfer material in the long nip portion, and obtain the high transfer efficiency.

The entire disclosure of Japanese Patent Application Nos: 2008-11327, filed Jan. 22, 2008 and 2008-242290, filed Sep. 22, 2008 are expressly incorporated by reference herein.

What is claimed is:

1. A transfer device comprising:

a first transfer belt onto which is transferred an image;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller;

a second drive force transmission mechanism that transmits a drive force to the third roller; and a drive force controller that controls the second drive force transmission mechanism in such a way that a relationship between a belt movement speed V2 of the second transfer belt and a belt movement speed V1 of the first transfer belt is V2/V1=a (where a is a constant of 1 or less).

2. The transfer device according to claim 1, wherein the second drive force transmission mechanism has a pulse motor, and the drive force controller controls the pulse motor by means of an input pulse.

3. The transfer device according to claim 1, still further comprising:

a cleaning member that abuts with the second transfer belt.

4. A transfer device comprising:

a first transfer belt onto which is transferred an image;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller;

a second drive force transmission mechanism that transmits a drive force to the third roller; and a variable contact pressure mechanism that makes variable a contact pressure of the third roller against the first roller via the first transfer belt and the second transfer belt, or a contact pressure of the fourth roller against the second roller via the first transfer belt and the second transfer belt; and a contact pressure controller that controls the variable contact pressure mechanism.

5. A transfer device comprising:

a first transfer belt onto which is transferred an image;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller; and a second drive force transmission mechanism that transmits a drive force to the third roller, wherein the second drive force transmission mechanism has a one-way clutch.

6. A transfer device comprising:

a first transfer belt onto which is transferred an image;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller;

a second drive force transmission mechanism that transmits a drive force to the third roller; and a bias application unit that applies a transfer bias to the third roller, whereby the first roller is grounded.

7. An image forming apparatus comprising:

an image carrier on which a latent image is formed;

a developing unit that develops the latent image with a liquid developer;

a first transfer belt to which an image developed by the developing unit is transferred;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller;

a second drive force transmission mechanism that transmits a drive force to the third roller; and a drive force controller that controls the second drive force transmission mechanism in such a way that a relationship between a belt movement speed V2 of the second transfer belt and a belt movement speed V1 of the first transfer belt is V2/V1=a (where a is a constant of 1 or less).

8. The image forming apparatus according to claim 7, wherein the second drive force transmission mechanism has a pulse motor, and the drive force controller controls the pulse motor by means of an input pulse.

9. The image forming apparatus according to claim 7, wherein the second drive force transmission mechanism has a one-way clutch.

10. The image forming apparatus according to claim 7, still further comprising:

a bias application unit that applies a transfer bias to the third roller, whereby the first roller is grounded.

11. An image forming apparatus comprising:

an image carrier on which a latent image is formed;

a developing unit that develops the latent image with a liquid developer;

a first transfer belt to which an image developed by the developing unit is transferred;

a first roller and a second roller on which the first transfer belt is wound;

a second transfer belt that makes contact with the first transfer belt;

a third roller on which the second transfer belt is wound, and that makes contact with the first roller via the first transfer belt and the second transfer belt;

a fourth roller on which the second transfer belt is wound, and that makes contact with the second roller via the first transfer belt and the second transfer belt;

a first drive force transmission mechanism that transmits a drive force to the first roller;

a second drive force transmission mechanism that transmits a drive force to the third roller;

a variable contact pressure mechanism that makes variable a contact pressure of the third roller against the first roller via the first transfer belt and the second transfer belt, or a contact pressure of the fourth roller against the second roller via the first transfer belt and the second transfer belt; and a contact pressure controller that controls the variable contact pressure mechanism.

12. The image forming apparatus according to claim 11, still further comprising:

a media type information input unit, wherein in accordance with media type information input into the media type information input unit, the second drive force transmission mechanism is controlled by the drive force controller.

13. The image forming apparatus according to claim 11, still further comprising:

a media type information input unit, wherein in accordance with media type information input into the media type information input unit, the variable contact pressure mechanism is controlled by the contact pressure controller.

* * * * *